US005725309A

United States Patent [19]

Robinson

[11] Patent Number: 5,725,309

[45] Date of Patent: Mar. 10, 1998

[54] PLASTIC CONTAINER PACKAGE

[75] Inventor: Gerald R. Robinson, Perrysburg, Ohio

[73] Assignee: Owens-Brockway Plastic Products Inc., Toledo, Ohio

[21] Appl. No.: 671,026

[22] Filed: Jun. 25, 1996

[51] Int. Cl.[6] ..... B65D 30/10

[52] U.S. Cl. ..... 383/7; 383/61; 383/63; 383/104; 383/105; 215/382

[58] Field of Search ..... 383/7, 61, 63, 383/104, 105, 906; 215/382

[56] References Cited

U.S. PATENT DOCUMENTS

| | | | |
|---|---|---|---|
| D. 205,733 | 9/1966 | Gould . | |
| D. 287,227 | 12/1986 | Turnbull . | |
| D. 293,081 | 12/1987 | Britt . | |
| D. 303,629 | 9/1989 | Olson . | |
| D. 319,784 | 9/1991 | Nylander . | |
| D. 323,981 | 2/1992 | Satterfield . | |
| 2,950,029 | 8/1960 | Winstead | 215/382 X |
| 2,999,627 | 9/1961 | Reinhardt . | |
| 3,159,697 | 12/1964 | Tocci . | |
| 3,367,380 | 2/1968 | Dickey | 383/906 X |
| 3,412,918 | 11/1968 | Sherman . | |
| 3,721,360 | 3/1973 | Collie . | |
| 3,880,311 | 4/1975 | McPhee . | |
| 4,127,206 | 11/1978 | Virog, Jr. et al. . | |
| 4,280,630 | 7/1981 | Hafele . | |
| 4,361,235 | 11/1982 | Gautier | 383/104 X |
| 4,496,066 | 1/1985 | Bullock . | |
| 4,676,389 | 6/1987 | Bullock . | |
| 4,930,644 | 6/1990 | Robbins, III | 383/119 X |
| 4,949,861 | 8/1990 | Cochran . | |
| 5,086,937 | 2/1992 | Robinson . | |
| 5,174,658 | 12/1992 | Cook et al. . | |

FOREIGN PATENT DOCUMENTS

| | | | |
|---|---|---|---|
| 3289451 | 12/1991 | Japan | 383/906 |
| 8912006 | 12/1989 | WIPO | 383/906 |

*Primary Examiner*—Jes F. Pascua

[57] ABSTRACT

A blow molded plastic container including a base including a bottom intended to rest upon a supporting surface. The base has a predetermined average thickness providing sufficient strength and rigidity to maintain its shape as molded. An integral body portion extends upwardly from the base. The body portion terminates in an open upper end. An integral handle extends from said shoulder portion. The integral handle is solid. The handle, at its line of juncture with the shoulder portion reduced thickness from other portions of the handle. The body portion has an average thickness less than the base predetermined average thickness. The average thickness is insufficient to permit the body portion to maintain its shape as molded during handling without supplementary support. The open upper end of the container is flexible such that the container can be filled and the upper end can be collapsed and sealed to define a package.

8 Claims, 5 Drawing Sheets

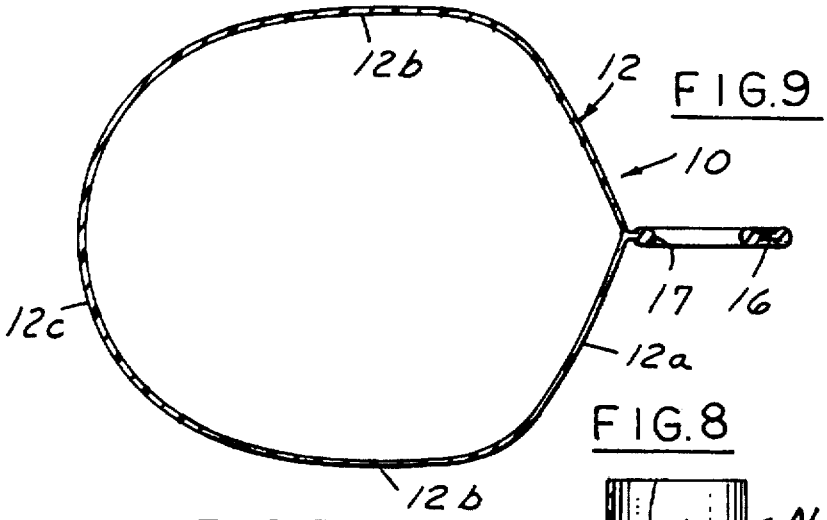
FIG.9
FIG.8
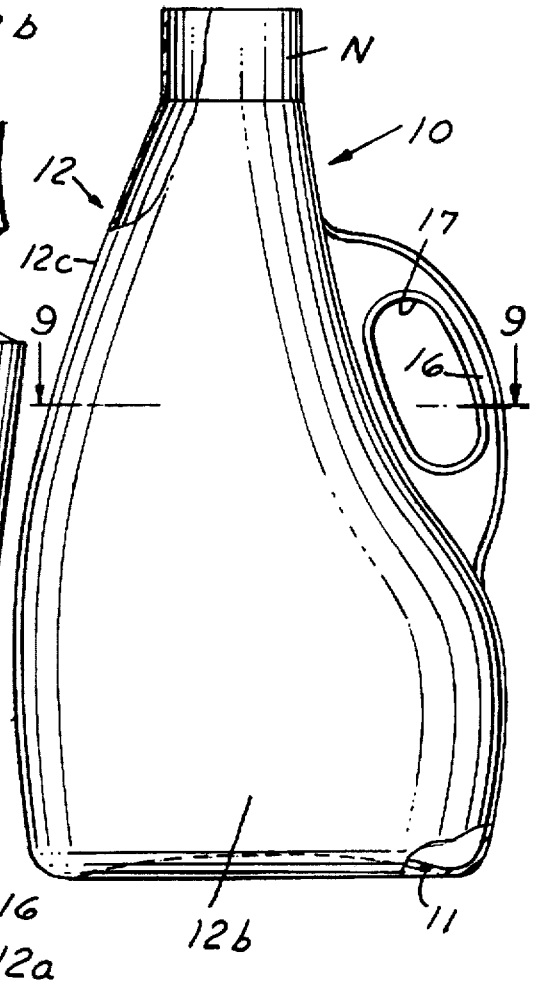
FIG.7
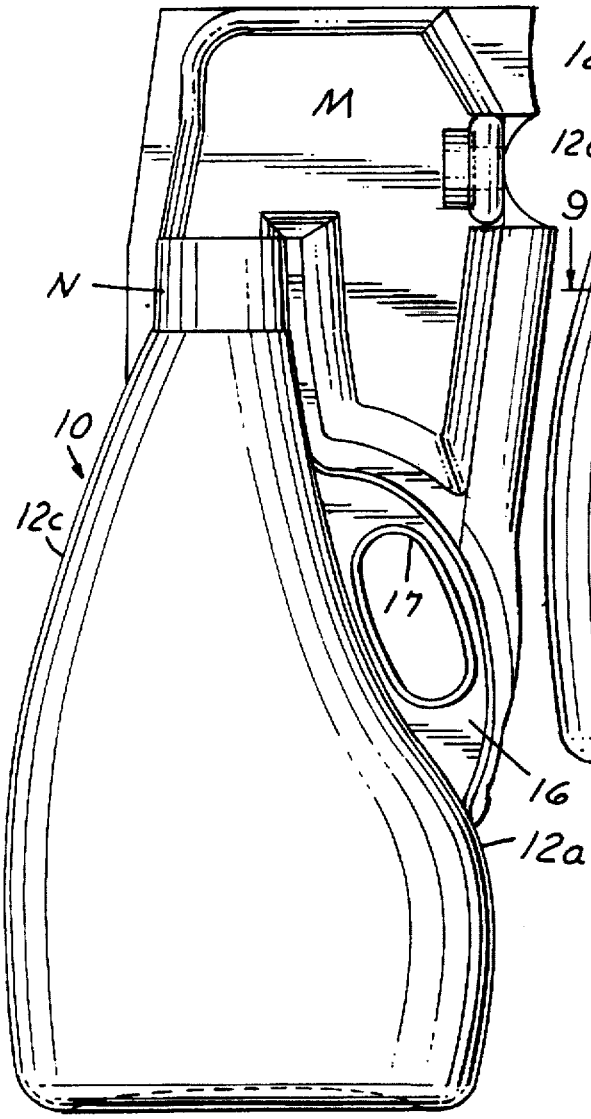

PLASTIC CONTAINER PACKAGE

The present invention relates to ultra lightweight plastic bottles and to a method and apparatus for forming such bottle.

BACKGROUND AND SUMMARY OF THE INVENTION

In the utilization of plastic bottles for packaging, one of the primary objects has always been to provide a bottle or other plastic package which utilizes as little plastic as possible and still permits the package to reach its intended market intact in a form which is convenient to use. Although attempts have been made to package products in flexible plastic bags including pouches and the so-called bag-in-a-box which has been utilized for packaging wine, for packages of 1 quart to 1 gallon in size, such flexible packaging has seen limited use. The reason for this appears to be that many of the products packaged in those sizes of containers are detergents and other common household products and the consumer desires to have a bottle, preferably one with a handle, for use in packaging such products.

In U.S. Pat No. 5,086,937 there is disclosed a plastic container comprising a base including a bottom intended to rest upon a supporting surface. The base has a predetermined average thickness providing sufficient strength and rigidity to maintain its shape as molded, an integral body portion extending upwardly from said base, the body portion terminates in an upper end. An integral handle extending from said shoulder portion, the integral handle is solid, the handle, at its line of juncture with said shoulder portion, has reduced thickness from other portions of said handle. The body portion central area has an average thickness less than said base predetermined average thickness. The central area average thickness is insufficient to permit the body portion to maintain its shape as molded during handling without supplementary supporting means.

The method and apparatus described comprises an extruded head which extrudes a tubular parison between mold halves which are closed about the parison. The parison is then blown to the final shape of the bottle. As described in the patent the base of the bottle has a target minimum thickness of 0.015–0.025 inch with an average thickness of 0.020–0.040 inch and a central rib for rigidity. The upper area has a target minimal thickness of 0.015–0.020 inch and an average wall thickness of 0.020–0.030 inch. In the area of the handle, the wall thickness is in no event less than 0.015 inch. The body portion includes a central area having a target maximum thickness of 0.012 inch and an average thickness of 0.008±0.002 inch, which is described as having limited ability to maintain a molded shape but the upper and lower areas divide sufficient strength and rigidity to permit handling.

Among the objectives of the invention are to provide an improved plastic container package that can be blow molded; which is light in weight; which has a flexible upper end through which it can be filled; wherein the upper end can be sealed after filling; and wherein the upper end can be readily opened.

In accordance with the invention, there is provided a blow molded plastic container including a base including a bottom intended to rest upon a supporting surface; The base has a predetermined average thickness providing sufficient strength and rigidity to maintain its shape as molded. An integral body portion extends upwardly from said base. The body portion terminates in an upper end. An integral handle extends from said shoulder portion. The integral handle is solid. The handle, at its line of juncture with the shoulder portion reduced thickness from other portions of the handle. The body portion has an average thickness substantially less than the base predetermined average thickness. The plastic container is formed with a neck during blow molding and the neck is cut off so that the container has an opening. The entire wall of the container is flexible and not sufficiently rigid to support the contents. The upper end of the container is flexible such that the container can be filled and the upper end can be collapsed and sealed to define a package which supports the contents. In another form, a resealable construction is provided.

DESCRIPTION OF THE DRAWINGS

FIG. 7 is an elevational view of the container showing the moil thereon.

FIG. 8 is side elevational of the container after the moil is removed.

FIG. 9 is a sectional view taken along the line 9—9 on FIG. 8.

DESCRIPTION

Figure 11:
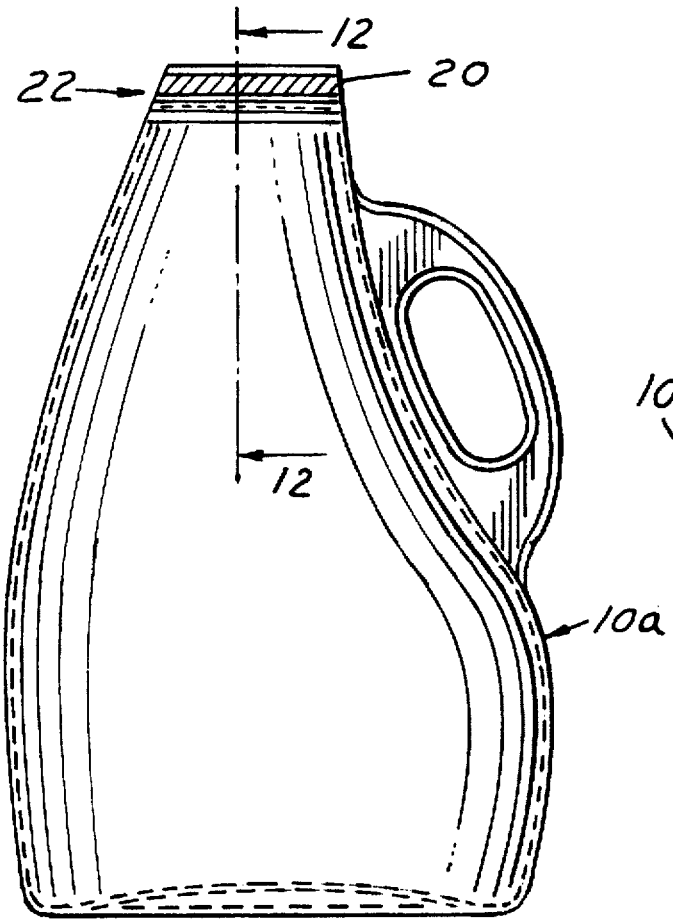
FIG. 11 is an elevational view of a modified form of the container.
Figure 12:
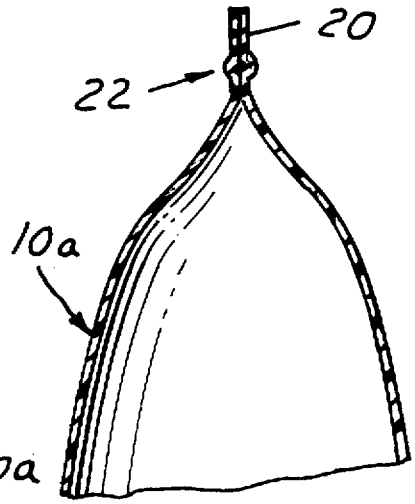
FIG. 12 is a fragmentary sectional view.
Figure 13:
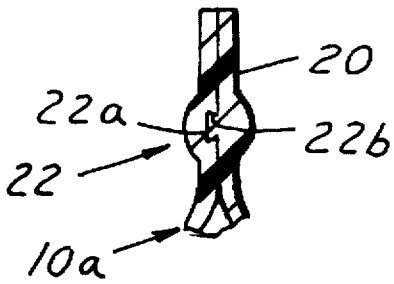
FIG. 13 is a fragmentary view similar to FIG. 12 on an enlarged scale taken along the line 11—11 in FIG. 11.

Referring now to FIGS. 1–9, there is provided a plastic bottle or container 10 having a bottom or base portion 11, a body portion 12 extending upwardly from the base portion and a neck portion 13 extending upwardly from the body portion 12 and having an opening 14 through which contents of the bottle may be dispensed. The bottle is preferably formed of high density polyethylene; however, it can be formed of a wide variety of other thermoplastic materials such as polypropylene, low density polyethylene and polyvinyl chloride. As may be seen in the drawings, there is also provided a handle 16 which is integrally formed with and extends from the upper body portion **12*d* (i.e., the shoulder) in an area adjacent the neck 13. The body portion 12 includes end walls 12*a*, 12*c* and side walls 12*b*, the side walls 12*b* being under the end walls. The side walls and end walls taper inwardly to the open end wherein which as shown in FIGS. 11–13, the neck 13** is transversely offset.

The handle 16 is formed integrally with the body portion 12 and is compression molded within the handle cavity of a mold as will be hereinafter described. The handle 16 has a finger hole opening 17 to permit the bottle 10 to be readily grasped and carried.

Figure 5:
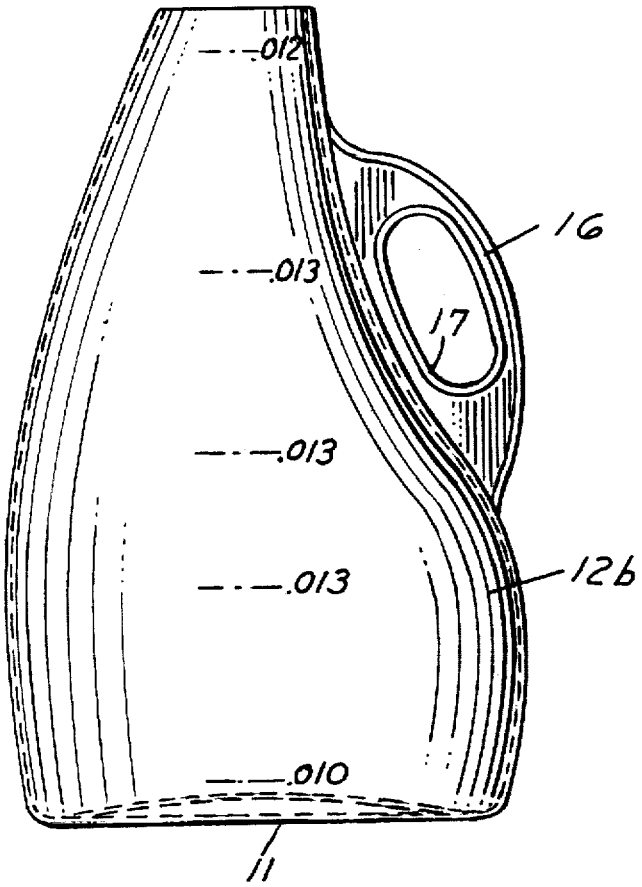
FIG. 5 is a side elevational view of the container before sealing.

Referring to FIG. 5, the base portion 11 is sufficiently thick to be a support for the filled container. However, the walls 12*a*, 12*b*, 12*c* have a wall thickness throughout which is insufficient to provide stability to support the contents before sealing. As viewed in FIG. 5, the side walls 12*b* preferably have a thickness of about 0.010" adjacent the base portion 11 increasing to a uniform thickness of about 0.013" in the mid portion and decreasing to a thickness of 0.012" at the top.

Figure 6:
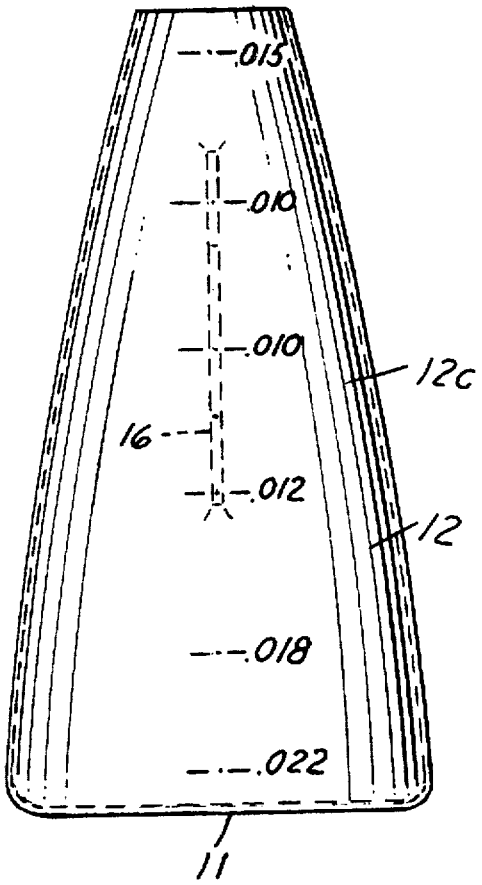
FIG. 6 is a side elevational view taken from the left in FIG. 5.

Referring to FIG. 6, in the end wall 12*c*, at the mold parting line, the thickness is preferably about 0.022" adjacent the base portion 11, decreases upwardly to 0.018", then to 0.012" and 0.010" in the middle and increases to 0.015" adjacent the upper end.

The opposite end wall 12*a* preferably has a thickness of about 0.025" adjacent the base portion 11, decreasing to about 0.020" and then increasing to about 0.025" below the handle.

Figure 1:
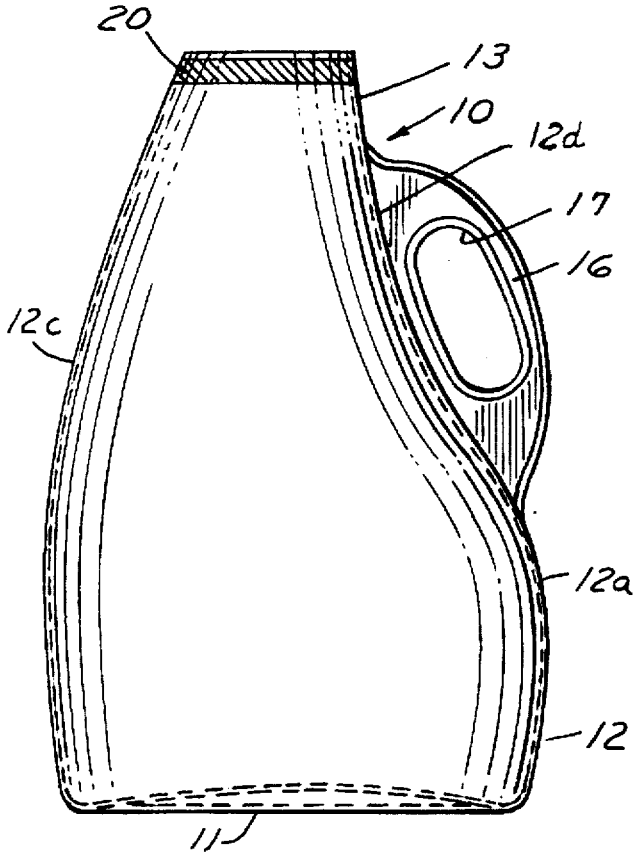
FIG. 1 is a side elevational view of a container embodying the invention.
Figure 4:
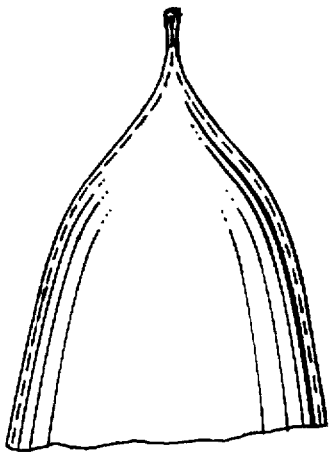
FIG. 4 is a fragmentary view taken from the left in FIG. 1.
Figure 2:
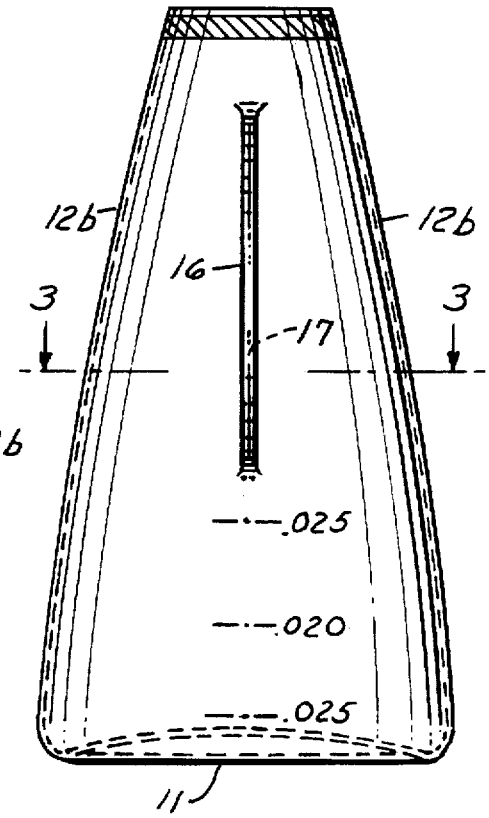
FIG. 2 is an elevational view taken from the right on FIG. 1.
Figure 3:
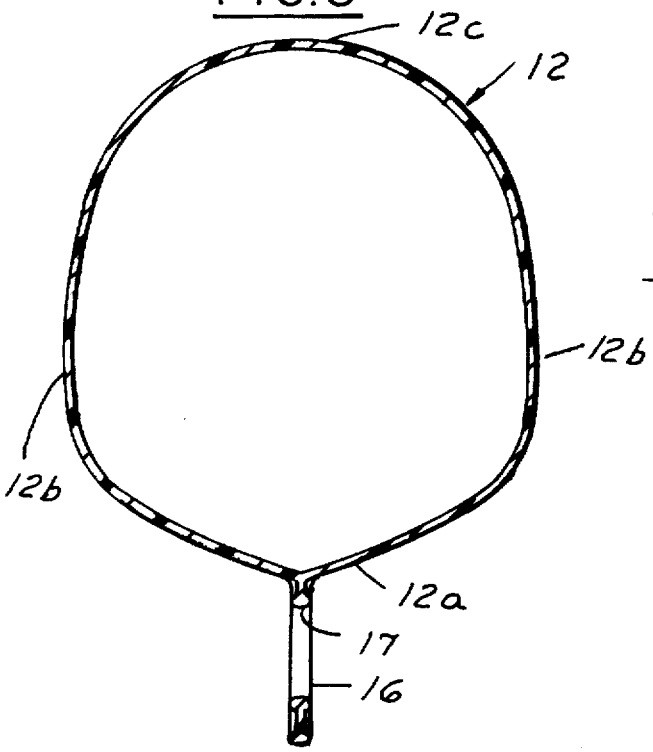
FIG. 3 is a sectional view taken along the line 3—3 in FIG. 1.

As shown in FIGS. 2, 5 and 6, the side and end walls are flexible throughout. After filling, sealing along line 20, as by heat sealing, and trimming the filled package has stability.

Figure 10:
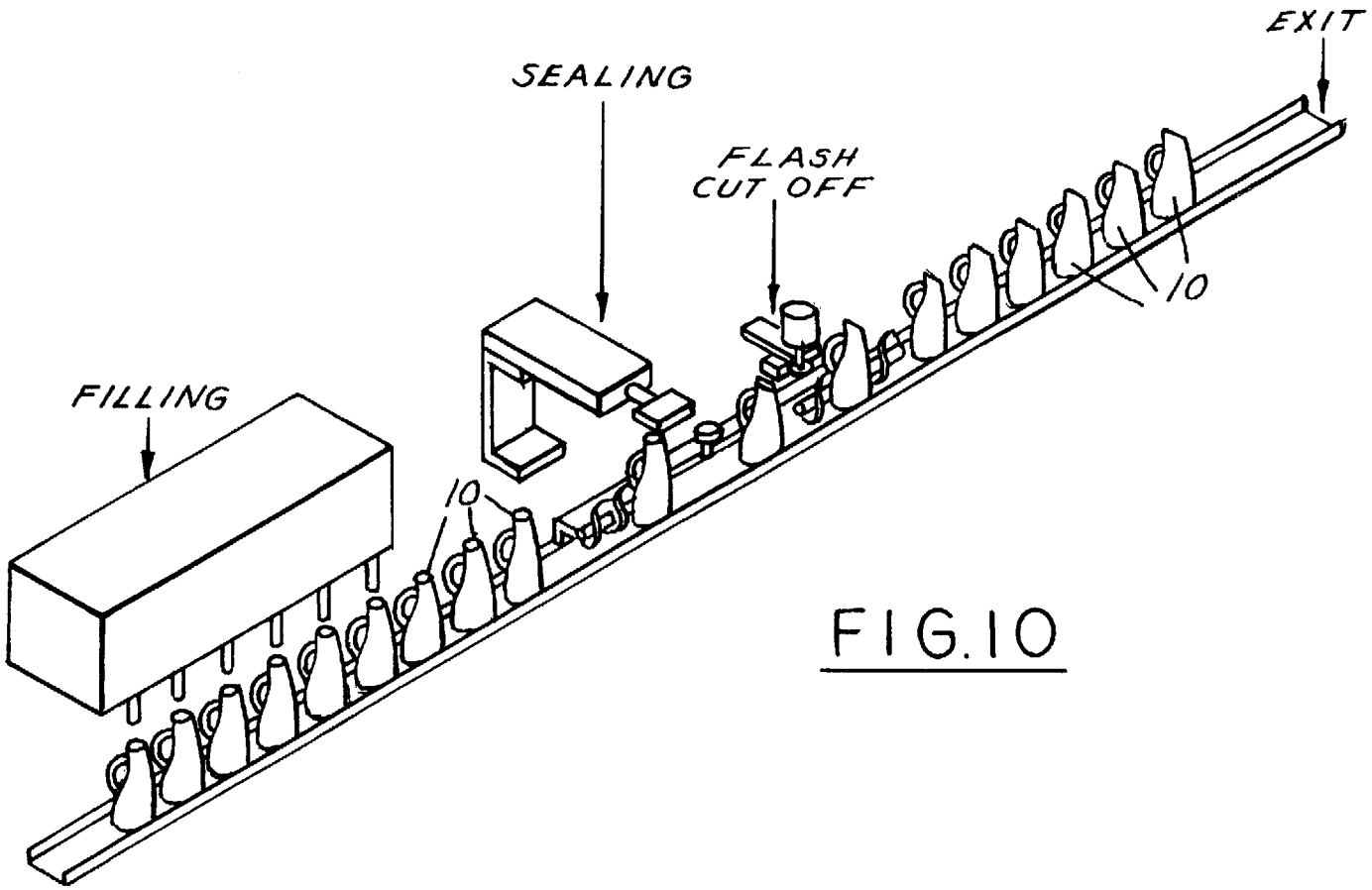
FIG. 10 is a diagrammatic view of the filling, sealing and trimming of the sealed container.

A system for handling the filling, sealing and trimming is shown in FIG. 10. After sealing the package, it is stable and sufficient rigidity is supplied by the seal to provide a stable free standing package.

In one method of making the container 10 by extrusion blow molding, the untrimmed container is shown in FIG. 9. Upon removal of the moil M, the container is further trimmed to remove the neck portion N (FIG. 8) thereby completing the container 10 to the configuration shown in FIGS. 5 and 6.

In the form similar to FIGS. 11–13, the container 10*a* is identical but a resealable construction 22 has been provided below the seal 20. Upon opening the filled container by the user to obtain access to the contents, the user can close the container to removably seal the remaining contents. One type of resealable connection comprises horizontal ribs 22*a* and complementary horizontal grooves 22*b* on the side walls into which the ribs 22*a* snap into. Such a construction is well known in the art of packaging.

It can thus be seen that there has been provided a plastic container package that can be blow molded; which is light in weight; which has a flexible upper end through which it can be filled; wherein the upper end can be sealed after filling; and wherein the upper end can be readily opened.

I claim:

1. A blow molded plastic container including a base including a bottom intended to rest upon a supporting surface, the base having a predetermined average thickness providing sufficient strength and rigidity to maintain its overall shape as molded, an integral body portion extending upwardly from said base, said body portion terminating in an open upper end, said body portion including side walls and end walls merging with respect to one another, said side walls being wider than the end walls, one of said end walls having a concave portion, an integral handle extending from said concave portion, said side walls and end walls tapering toward said open end to define a generally oval open end, said body portion having an average thickness less than the base predetermined average thickness of said base, said body portion having an average thickness which is sufficient to maintain its shape as molded, said body portion having an average thickness which is sufficient to permit the body portion including the open upper end to maintain its shape as molded, said body portion having a central area with a thickness which is insufficient to maintain its shape as molded during handling without supplementary support, said side walls of said container being thicker at the center area thereof and thinner adjacent the base, said open upper end of the container being flexible such that the container can be filled and the upper end can be collapsed and sealed along a line extending generally parallel to said side walls to define a package.

2. The plastic container set forth in claim 1 wherein said end wall on which said handle is provided has a thickness of about 0.025" adjacent the base, decreasing to about 0.020" and then increasing to about 0.025" below the handle.

3. The plastic container set forth in claim 2 wherein said end wall opposite said handle has a thickness of about 0.022" adjacent the base, decreases upwardly to 0.018", then to 0.012" and 0.010" in the middle and increases to 0.015" adjacent the upper end.

4. The plastic container set forth in claim 1 wherein said side walls have a thickness of about 0.010" adjacent the base portion increasing to a uniform thickness of about 0.013" in the mid portion and decreasing to a thickness of 0.012" at said open upper end.

5. The plastic container set forth in claim 4 including resealable means at the open upper end.

6. The plastic container set forth in claim 5 wherein said resealable means comprises transverse ribs on one side wall and complementary grooves on said other side wall.

7. The plastic container set forth in claim 1 including sealable edges spaced from the open end and extending transversely along a line generally parallel to the side walls.

8. The plastic container set forth in any one of claims 1–7 in combination with a product in said container, said open end of said container being flexed and sealed transversely along a seal line generally parallel to the side walls to seal the contents and provide a stable package.

* * * * *